US005171912A

United States Patent [19]

Harandi

[11] Patent Number: 5,171,912

[45] Date of Patent: Dec. 15, 1992

[54] PRODUCTION OF $C_5$+ GASOLINE FROM BUTANE AND PROPANE

[75] Inventor: Mohsen N. Harandi, Lawrenceville, N.J.

[73] Assignee: Mobil Oil Corp., Fairfax, Va.

[21] Appl. No.: 682,999

[22] Filed: Apr. 10, 1991

[51] Int. Cl.[5] ..... C07C 1/00

[52] U.S. Cl. ..... 585/301; 585/300; 585/302; 585/303; 585/304; 585/708; 585/752

[58] Field of Search ..... 585/300, 301, 302, 303, 585/304, 708, 752

[56] References Cited

U.S. PATENT DOCUMENTS

| | | | |
|---|---|---|---|
| 3,676,522 | 7/1972 | Sieg | 585/303 |
| 3,718,706 | 2/1973 | Sieg | 585/708 |
| 4,324,646 | 4/1982 | Le Page et al. | 585/304 |
| 4,642,404 | 2/1987 | Shihabi | 585/415 |
| 4,665,265 | 5/1987 | Chu et al. | 585/533 |
| 4,686,316 | 8/1987 | Morrison | 585/708 |
| 4,754,100 | 6/1988 | Sorensen et al. | 585/708 |

OTHER PUBLICATIONS

U.S. patent application 210,177 filed Jun. 20, 1988.

*Primary Examiner*—W. J. Shine
*Assistant Examiner*—E. D. Irzinski
*Attorney, Agent, or Firm*—Alexander J. McKillop; Charles J. Speciale; Dennis P. Santini

[57] ABSTRACT

A process is disclosed that provides a high conversion of n-butane to $C_5$+ gasoline by integrating the medium pore metallosilicate catalyzed process for fresh n-butane conversion to $C_5$+ gasoline with a medium pore metallosilicate catalyzed process for propane conversion in a manner which allows a portion of the propane by-product of n-butane conversion to be converted to $C_4$+ alkanes, followed by recycle of the n-butane portion of the $C_4$+ alkanes. It has been discovered that separation of the products from the separate propane and n-butane conversion steps can be carried out concurrently in a single fractionator to provide the $C_5$+ gasoline product and the propane and butane recycle streams. Preferably, the fractionator butane cut is treated in a deisobutanizer to recover isobutane and n-butane recycle. A further discovery utilizes the common fractionator not only to separate the products from the conversion processes but to concurrently separate a mixed fresh $C_3$–$C_4$ feedstream to the integrated process.

22 Claims, 2 Drawing Sheets

PRODUCTION OF $C_5$+ GASOLINE FROM BUTANE AND PROPANE

FIELD OF THE INVENTION

This invention relates to a process for the production of gasoline from lower paraffins comprising butane and propane. The invention particularly relates to a continuous integrated process for the independent conversion of normal butane and propane to higher hydrocarbons that includes a means for utilizing a single fractionator to separate the conversion products as well as the mixed $C_3/C_4$ paraffinic conversion feedstream.

BACKGROUND OF THE INVENTION

Modern petroleum refinery practices regularly result in the production of large quantities of lower alkanes, particularly propane and n-butane, as by-products of gasoline and distillate production. The supply of by-products so produced far exceeds their chemical or energy demand in the marketplace so, as a consequence, they are largely consumed as fuel within the refinery complex. It now appears that recent changes in clean air emission regulations will further compromise the commercial utilization of these lower alkanes to the extent that such regulations reduce permissible hydrocarbon emissions from gasoline and compel a lowering of gasoline butane content. Faced with a new surfeit of propane and n-butane in the refinery, the petroleum industry is challenged to develop ways to upgrade these hydrocarbons to higher value marketable products.

Normal butane is a component found in substantial amounts in well-head condensates and straight run gasoline, and is formed in a fuels refinery employing catalytic reforming and/or cracking processes. Propane is also recovered from light petroleum fractions and as a by-product of reforming and/or cracking operations. Usually, propane and normal butane occur as a mixture produced from refinery operations. Normal butane can be isomerized to isobutane and the latter can be alkylated to provide a gasoline blending stock, but this is an expensive conversion. Propane can be hydrogenated to propene and used as a chemical feedstock. However, neither normal butane nor propane are employed in high value applications commensurate with their availability.

In recent years, a major development within the petroleum industry has been the discovery of the special catalytic capabilities of a family of zeolite catalysts based upon medium pore size shape selective metallosilicates. Discoveries have been made leading to a series of analogous processes drawn from the catalytic capability of zeolites. Depending upon various conditions of space velocity, temperature and pressure lower oxygenates, alkenes and alkanes can be converted in the presence of zeolite type catalyst to higher hydrocarbons including higher olefins, gasoline or distillate, or converted further to produce aromatics. The light aliphatic hydrocarbon conversion process to form aromatics may utilize conversion conditions described in U.S. Pat. Nos. 3,760,024 (Cattanach); 3,845,150 (Yan and Zahner); 4,097,367 (Haag et al.); 4,350,835 (Chester et al.); 4,590,323 (Chu); and 4,629,818 (Burress) incorporated herein by reference. The feedstream consists essentially of $C_2$–$C_4$ paraffins and/or olefins.

U.S. Pat. No. 4,686,316 to Morrison, incorporated herein by reference, discloses a process for the production of butanes from propane by contacting with ZSM-5 zeolite catalyst at moderately high reaction operating pressure in the absence of added hydrogen. A mixture of normal butane and isobutane is produced with high selectivity.

The foregoing processes individually illustrate that, depending on process conditions employing medium pore shape selective metallosilicate catalyst, light paraffins can be upgraded to aromatics, propane can be selectively upgraded to butanes.

Accordingly, it is an object of the present invention to improve the utilization of propane and butanes in the refinery complex by providing an integrated process for the conversion of propane and normal butane to $C_5$+ gasoline.

A further object of the invention is to provide a high octane aromatics and/or $C_5$–$C_6$ paraffins rich gasoline from the integrated conversion of propane and normal butane.

Another object of the invention is to provide the foregoing integrated process wherein a single fractionator is used to separate a feedstream containing propane and butanes as well as the products from the individual conversion steps.

SUMMARY OF THE INVENTION

It has been discovered that a high conversion of n-butane to $C_5$+ gasoline can be realized by integrating the medium pore metallosilicate catalyzed process for n-butane conversion to $C_5$+ gasoline with a medium pore metallosilicate catalyzed process for propane conversion in a manner which allows a portion of the propane by-product of n-butane conversion to be converted to $C_4$+ alkanes, followed by recycle of the n-butane and/or isobutane portion of the $C_4$+ alkanes. Advantageously, it has been discovered that separation of the products from the separate propane and n-butane conversion steps can be carried out concurrently in a single fractionator to provide the $C_5$+ gasoline product and the propane and butane recycle streams. Preferably, the fractionator butane cut is treated in a deisobutanizer to recover isobutane as a product stream and n-butane as recycle. A further discovery utilizes the common fractionator not only to separate the products from the conversion processes but to concurrently separate a mixed $C_3$–$C_4$ feedstream to the integrated process.

More particularly, the invention comprises a continuous integrated process for the conversion of n-butane to $C_5$+ gasoline, containing the steps of: contacting a fresh feedstream comprising normal butane with shape selective medium pore zeolite catalyst particles under conditions sufficient to convert n-butane to an effluent stream comprising $C_3$+ alkanes; separating the effluent stream in a fractionator to recover an overhead stream comprising propane; contacting the propane stream and/or a fresh propane feedstream with shape selective, medium pore zeolite catalyst particles under conversion conditions sufficient to convert propane to a mixture comprising $C_2$+ alkanes; deethanizing the mixture and passing the deethanized product comprising $C_3$+ alkanes to the fractionator for separation concurrent with the effluent stream; recovering a bottom stream comprising $C_5$+ gasoline from the fractionator; preferably, distilling an intermediate stream comprising $C_4$ alkanes from the fractionator and recovering a stream comprising isobutane and a stream comprising unconverted normal butane; recycling the unconverted normal butane to the normal butane feedstream to the integrated process.

In another embodiment of the integrated process the fresh n-butane feedsteam can be eliminated and a $C_3$–$C_4$ feedstream passed to the fractionator for separation and integration with the aforementioned propane and butane cuts from the fractionator which are passed to the respective propane and n-butane conversion zones.

DETAILED DESCRIPTION OF THE INVENTION

Figure 1:
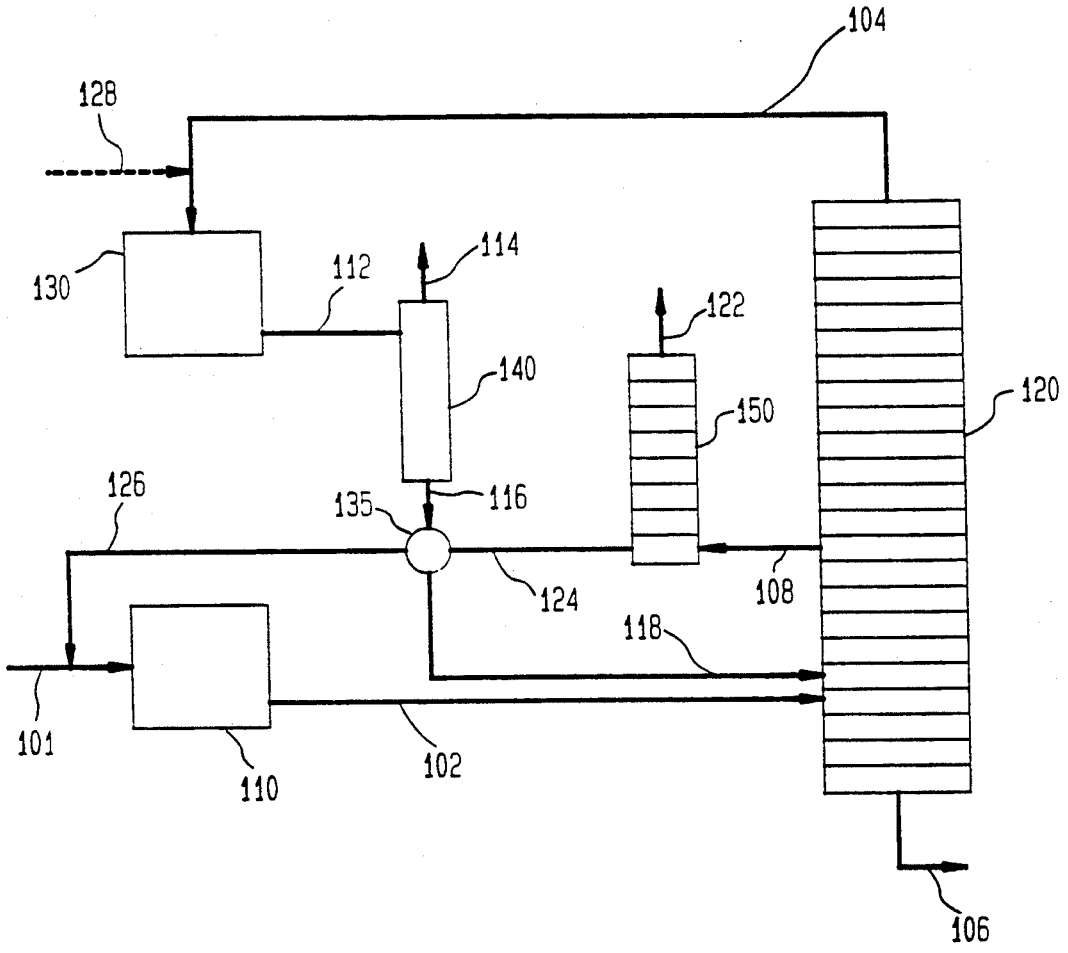
FIG. 1 is a schematic representation of an embodiment of the instant invention utilizing a fresh n-butane feedstream.

The present invention comprises an integrated continuous process for the production of $C_5$+ gasoline from propane and normal butane by separating a fresh $C_3$–$C_4$ paraffinic hydrocarbon feedstream in a fractionator and recovering a stream comprising propane and another stream rich in normal butane. The propane stream is contacted with shape selective, medium pore zeolite catalyst particles in a propane conversion zone under propane conversion conditions whereby an effluent stream is produced rich in $C_4$+ paraffinic hydrocarbons. The normal butane stream is contacted with shape selective, medium pore zeolite catalyst particles in a normal butane conversion zone under normal butane conversion conditions whereby an effluent stream is produced rich in $C_3$+ paraffinic hydrocarbons. The streams from the two reaction zones are separated in a fractionator in conjunction with the $C_3$–$C_4$ feedstream whereby a bottom stream is recovered from said fractionator comprising $C_5$+ gasoline.

The process of the instant invention utilizes a high severity reaction section to convert propane to alkanes comprising $C_2$ and $C_4$+, or $C_2$+, hydrocarbons in contact with zeolite catalyst, and a lower severity reaction section to convert normal butane to alkanes comprising propane and $C_4$+ hydrocarbons in contact with zeolite catalyst. A single fractionator is used to fractionate a $C_3$–$C_4$ feedstream to the process and fractionate the products of the conversion reactions. The fractionator bottom stream contains the gasoline product. The top fractionator overhead product and a side stripper bottoms stream provide a $C_3$ rich feed stream and a $C_4$ rich feed stream, respectively. The feedstream to the process may also comprise fresh n-butane fed directly to the butane upgrader. Optionally, light aromatics such as benzene and/or olefins rich streams may be added to either conversion zone containing zeolite catalyst to improve product octane and/or yield.

The propane upgrader operates at least 50° F. and preferably at least 150° F. (28° to 84° C.) higher temperature than the butane upgrader, assuming the same catalyst activity and weight hourly space velocity (WHSV). In addition, if olefins or aromatics are added to the propane upgrader the propane upgrading reaction becomes highly exothermic. Therefore, the heat content of the propane upgrader effluent can be used to supply a portion of the butane upgrading feed preheat. This can eliminate the need for a fired furnace which may be environmentally undesirable in the process.

As previously noted, propane upgrading is described in U.S. Pat. No. 4,686,316. Propane is effectively converted with unexpectedly high selectivity to a mixture of normal butane, isobutane and $C_5$+ gasoline by contact with certain intermediate pore size zeolites, as more fully described hereinbelow. In particular, the process for the production of butanes and $C_5$+ gasoline from propane, which process comprises contacting in the absence of added hydrogen and at a pressure of at least about 50 psig a feed consisting essentially of propane with a catalyst comprising a crystalline zeolite having a silica-to-alumina ratio of at least 12 and a Constraint Index of 1 to 12, said contacting being conducted under a combination of conditions of temperature, pressure, and WHSV effective to convert said propane to a mixture of hydrocarbons that contain butanes in an amount equal to at least 35 wt % of said converted propane. The total effluent from the catalytic reactor will also contain unreacted propane. Separation can provide a hydrocarbon fraction that may contain as much as 80+ wt. % of mixed butanes from which an isobutane fraction may be obtained that is useful for conversion to alkylate blending stock for gasoline.

In general, the effective combinations of process conditions for propane upgrading will have individual parameters falling within the ranges shown below:

| | Broad | Preferred |
|---|---|---|
| Temperature, | 500–900° F. | 600–800° F. |
| Pressure, psig | 50–1500 | 400–1000 |
| WHSV | 0.1 to 10 | 0.2 to 2.0 |

The catalysts useful in the process for the conversion of propane as described herein comprise shape selective metallosilicate catalyst having a Constraint Index (C. I.) between about 1 and 12. It is preferred to use a zeolite selected from the group consisting of ZSM-5, ZSM-11, ZSM-12, ZSM-22, ZSM-23, ZSM-34, ZSM-35, ZSM-48, ZSM-50, MCM-22 and zeolite Beta as the zeolite component of the catalyst used in the process of this invention. ZSM-5 is the particularly preferred zeolite.

ZSM-5 is more particularly described in U.S. Pat. No. Re. 28,341 (of original U.S. Pat. No. 3,702,886), the entire contents of which are incorporated herein by reference.

ZSM-11 is more particularly described in U.S. Pat. No. 3,709,979, the entire contents of which are incorporated herein by reference.

Zeolite ZSM-12 is described in U.S. Pat. No. 3,832,449, to which reference is made for the details of this catalyst.

ZSM-22 is more particularly described in U.S. Pat. No. 4,046,859, the entire contents of which is incorporated herein by reference.

ZSM-23 is more particularly described in U.S. Pat. No. 4,076,842, the entire contents of which are incorporated herein by reference.

ZSM-35 is more particularly described in U.S. Pat. No. 4,016,245, the entire contents of which are incorporated herein by reference.

ZSM-48 is more particularly described in U.S. Pat. No. 4,397,827, the entire contents of which are incorporated herein by reference.

Zeolite ZSM-50 is described in U.S. Pat. No. 4,640,829, to which reference is made for details of this catalyst.

MCM-22 is more particularly described in U.S. Pat. No. 4,954,325, the entire contents of which are incorporated herein by reference.

Zeolite Beta is described in U.S. Pat. No. Re. 28,341 (of original U.S. Pat. No. 3,308,069), to which reference is made for details of this catalyst.

It is particularly effective to include a hydrogenation-dehydrogenation metal in the zeolite catalyst composition employed in the propane upgrading process. Phosphorous-containing zeolites such as ZSM-5 containing phosphorous can also be effective. Although the process can be practiced in the absence of an hydrogenation-dehydrogenation component, in some instances the presence of such component induces an increase in activity and/or selectivity. Platinum or palladium metal acts in such fashion. Other metals which can facilitate hydrogenation-dehydrogenation or olefin disproportionation, such as the Fe or Pt metals of Group VIII of the Periodic Table, metals of Group IIb, titanium, vanadium, chromium, molybdenum, tungsten, rhenium and gallium, may be useful. (Chem. Rubber Handbook, 45th Ed., back cover).

Normal butane is converted directly to propane and high octane gasoline with no substantial formation of hydrocarbons having less than three carbon atoms by contact with intermediate pore size zeolites such as HZSM-5 under specified conversion conditions including a relatively low temperature of not more than 800° F. (426° C.) and a pressure of at least 400 psig (2800 kPa). The butane upgrading process provides a simple catalytic process for the production of propane and high octane gasoline, which process comprises contacting in the absence of added hydrogen at a temperature of 475° F. (246° C.) to about 800° F. (426° C.) and at a pressure of 600 to about 2000 psig (4200–14,000 kPa) a feed consisting essentially of n-butane with a catalyst comprising a crystalline zeolite having a silica-to-alumina ratio of at least 12 and a Constraint Index of 1 to 12, said contacting being conducted under a combination of conditions of temperature, pressure, and WHSV effective to convert about 45 wt % to about 90 wt % of said n-butane to a mixture of propane and heavier hydrocarbons, with no substantial conversion to hydrocarbon by-products having less than three carbon atoms. Propane and high octane gasoline are readily recovered from the reaction mixture. The total effluent from the catalytic reactor will contain unreacted normal butane and a small amount of isobutane. The isobutane preferably is separated and diverted to an alkylation unit.

The n-butane catalytic conversion is effected under a combination of conditions of temperature, pressure, and weight hourly space velocity (WHSV) effective to convert in a single pass up to about 90 wt % of the butane feed to a $C_3$ plus mixture of hydrocarbons without substantial formation of hydrocarbon by-product having less than three carbon atoms. In general, increase of temperature, or of pressure, or decrease of space velocity all serve to increase conversion, so that many combinations of these parameters will produce conversion and selectivity within the desired range. In general, the effective process conditions will have individual parameters falling within the ranges shown below:

| | Broad | Preferred |
|---|---|---|
| Temperature, | 475–800° F. | 550–750° F. |
| Pressure, psig | 400–2000 | 600–1500 |
| WHSV | 0.1–50 | 0.1–10 |

Within the described constraints, high single pass conversions with useful yields of propane and $C_5$ plus gasoline are achieved without encountering rapid aging.

The catalysts useful in the process for the conversion of normal butane as described herein comprise shape selective metallosilicate catalyst having a Constraint Index (C. I.) between about 1 and 12. It is preferred to use a zeolite selected from the group consisting of ZSM-5, ZSM-11, ZSM-12, ZSM-22, ZSM-23, ZSM-34, ZSM-35, ZSM-48, ZSM-50, MCM-22 and zeolite Beta as the zeolite component of the catalyst used in the process of this invention. ZSM-5 is the particularly preferred zeolite.

The zeolite catalyst is converted to the hydrogen form prior to use in the process of this invention. The catalyst, after extended use in the process of this invention, will require regeneration to restore activity. This may be effected with hydrogen gas at elevated temperature, or by burning in air, or by combinations thereof.

A convenient measure of the extent to which a zeolite provides controlled access to molecules of varying sizes to its internal structure is the aforementioned Constraint Index of the zeolite. A zeolite which provides relatively restricted access to, and egress from, its internal structure is characterized by a relatively high value for the Constrain Index, i.e., above about 2. On the other hand, zeolites which provide relatively free access to the internal zeolitic structure have a relatively low value for the Constraint Index, i.e., about 2 or less. The method by which Constraint Index is determined is described fully in U.S. Pat. No. 4,016,218, to which reference is made for details of the method.

Constraint Index (CI) values for some zeolites which can be used in the process of this invention are:

| Zeolite | Constraint Index (At Test Temperature, °C.) |
|---|---|
| ZSM-5 | 6–8.3 (371–316) |
| ZSM-11 | 5–8.7 (371–316) |
| ZSM-12 | 2.3 (316) |
| ZSM-35 | 4.5 (454) |
| ZSM-48 | 3.5 (538) |
| ZSM-50 | 2.1 (427) |
| Zeolite Beta | 0.6–2.0 (316–399) |

The above-described Constraint Index is an important and even critical definition of those zeolites which are useful in the instant invention. The very nature of this parameter and the recited technique by which it is determined, however, admit of the possibility that a given zeolite can be tested under somewhat different conditions and thereby exhibit different Constraint Indices. Constraint Index seems to vary somewhat with severity of operation (conversion) and the presence or absence of binders. Likewise, other variables, such as crystal size of the zeolite, the presence of occluded contaminants, etc., can affect the Constraint Index. Therefore, it will be appreciated that it may be possible to so select test conditions, e.g., temperatures, as to establish more than one value for the Constraint Index of a particular zeolite. This explains the range of Constraint Indices for zeolite Beta.

Referring to FIG. 1, one embodiment of the instant invention is illustrated in a process schematic. A $C_4$ feedstream 101 is passed to a reactor zone 110 containing medium pore shape selective metallosilicate catalyst. Optionally, if the feedstream 101 contains isobutane a separation step to recover isobutane can be carried out in deisobutanizer 150. Under relatively low severity reaction conditions as previously described herein normal butane is converted 110 to alkanes consisting of propane and higher hydrocarbons. The effluent 102 from the conversion zone 110 also contains unconverted normal butane and a small amount of $C_2-$ hydrocarbons in addition to propane and $C_5+$ alkanes. The effluent 102 is passed to fractionator 120 for separation into an overhead stream 104 comprising propane, a bottom stream 106 comprising $C_5+$ gasoline and an intermediate fractionator cut 108 comprising $C_4$ hydrocarbons including isobutane. The propane 104 stream is introduced into reactor zone 130 containing medium pore shape selective metallosilicate catalyst particles under high severity reaction conditions previously described herein. In the conversion zone 130 propane is converted to $C_2+$ alkanes. The effluent 112 from conversion zone 130 contains unconverted propane as well as ethane rich light gases and $C_4+$ paraffinic hydrocarbons. The effluent 112 is passed to a separator comprising deethanizer 140 wherein a stream 114 comprising $C_2-$ hydrocarbons is removed overhead. From the deethanizer unconverted propane and $C_4+$ hydrocarbons are passed 116 and 118 to fractionator 120 for separation of the components into propane $C_5+$ gasoline and $C_4$ hydrocarbons. Preferably, $C_4$ hydrocarbons in stream 108 from the fractionator 120 are further separated by fractionation in a deisobutanizer 150 to recover isobutane stream 122 which may be utilized for alkylation or dehydrogenated to produce isobutene. Stream 124 consists primarily of normal butane which is recycled 126 to the normal butane feedstream 101. Optionally, stream 126 is recycled through heat exchanger 135 to recover some of the heat from stream 116 from the high severity zone 130. This recovered heat is effective in preheating fresh normal butane feedstream 101; thereby reducing furnace requirements to preheat the total feed to reaction zone 110. Also, a fresh propane, olefinic, and/or aromatics stream can be introduced in the process through feedstream 128 to enhance the process yield and/or the octane value of the $C_5$ gasoline recovered in stream 106.

The fractionator 120 may also be designed as two towers: one for debutanizing and one for depropanizing the debutanizer overhead; or a depropanizer followed by a debutanizer.

Figure 2:
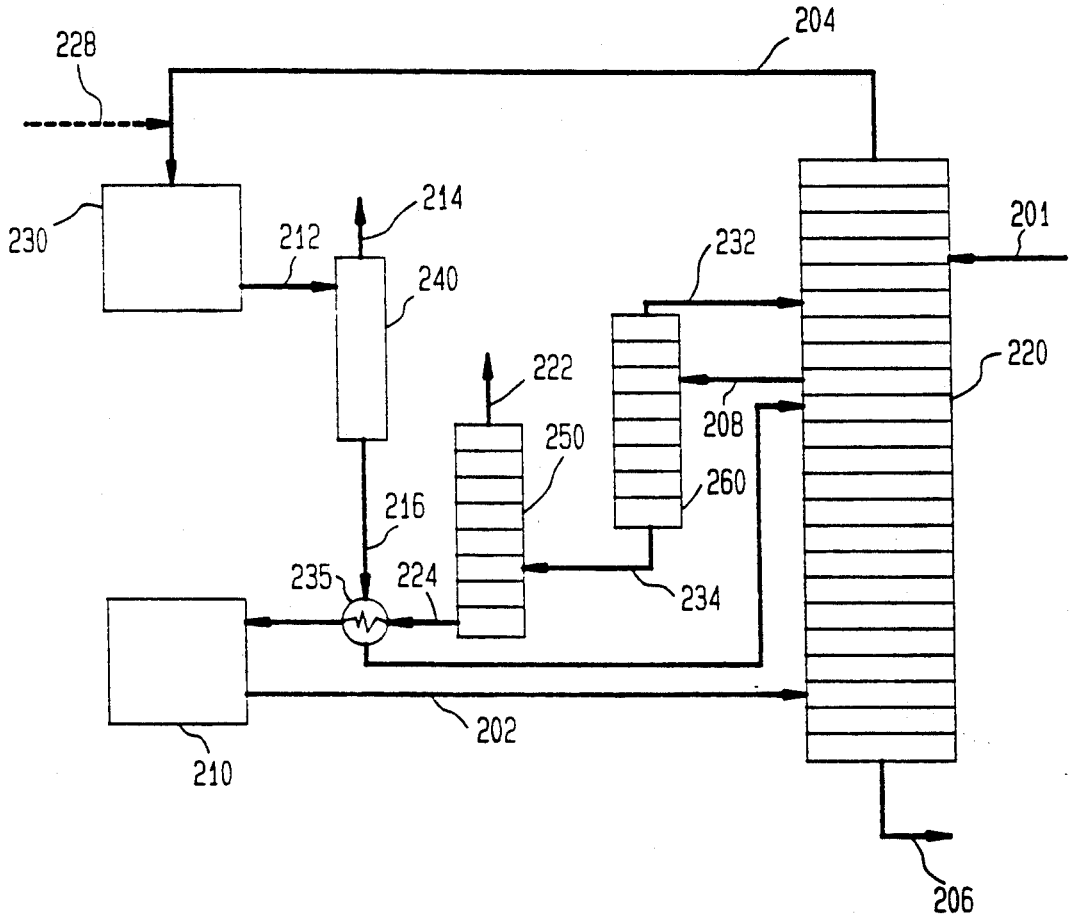
FIG. 2 is a schematic representation of an embodiment of the instant invention utilizing a $C_3$–$C_4$ feedstream to the process wherein the single fractionator is employed to separate products and feedstream components simultaneously.

Referring now to FIG. 2, another embodiment of the instant invention is illustrated in a process schematic. This embodiment differs fundamentally from the embodiment described in FIG. 1 in that it illustrates a means for utilizing the main fractionator 220 of the process for separation of a fresh paraffinic feedstream 201 comprising $C_3$–$C_4$ hydrocarbons as well as or concurrent with the separation of products from the individual propane 230 and normal butane 210 conversion zones. FIG. 2 also illustrates the use of stripper 260 wherein the $C_4$ rich intermediate stream from fractionator 220 is separated to recycle 232 $C_3$ alkanes to the fractionator 220 while passing 234 $C_4$'s to deisobutanizer 250. With these distinctions presented, the process illustrated in FIG. 2 is analogous to that described in FIG. 1. Propane from fractionator 220 is passed 204 as an overhead stream to the high severity conversion zone 230 containing the previously described zeolite catalyst. The $C_2+$ effluent 212 from 230 is separated in deethanizer 240 to produce a $C_2-$ overhead stream 214 and a stream 216 comprising $C_4+$ hydrocarbons and unconverted propane which is passed to fractionator 220 for separation. Normal butanes are recovered from the fractionator by separation of intermediate fractionator cut 208 in stripper 260 from which propane overhead is recycled to the fractionator as described above. The $C_4$ stream 234 is preferably deisobutanized 250 to provide the isobutane stream 222 and the normal butane stream 224. Isobutane may be utilized in alkylation or dehydrogenated to provide isobutene. Heat exchanger 235 can optionally be employed to recover heat from the deethanizer effluent 216 and preheat the normal butane feedstream to the normal butane conversion zone 210. In the 210 conversion zone normal butane is converted to $C_3+$ paraffinic hydrocarbons. The effluent 202 from 210 is separated in the main process fractionator 220 concurrently with separation of the fresh $C_3$–$C_4$ feedstream 201. $C_5+$ gasoline is recovered as a bottom stream 206 from the fractionator 220. As with the embodiment described in FIG. 1, a fresh propane, olefinic, and/or aromatics stream can be introduced in the process through feedstream 228 to enhance the process yield and/or the octane value of the $C_5$ gasoline recovered 206.

The fractionator 220 may also be designed as two towers: one for debutanizing and one for depropanizing the debutanizer overhead; or a depropanizer followed by a debutanizer.

Although the present invention has been described with preferred embodiments, it is to be understood that modifications and variations may be resorted to, without departing from the spirit and scope of this invention, as those skilled in the art will readily understand. Such modifications and variations are considered to be within the purview and scope of the appended claims.

What is claimed is:

1. An integrated process for the production of $C_5+$ gasoline from a $C_3$–$C_4$ paraffin-rich hydrocarbon feedstream, comprising:

a) separating fresh $C_3$–$C_4$ paraffinic hydrocarbon feedstream in a fractionator to provide an overhead stream comprising propane and an intermediate stream rich in $C_4$ paraffinic hydrocarbons;

b) contacting the propane stream with shape selective, medium pore zeolite catalyst particles in a conversion zone under conditions comprising temperature between about 500° and 900° F., pressure between about 50 and 1500 psig, and weight hourly space velocity between about 0.1 and 10 to convert said propane to a mixture comprising $C_2+$ alkanes;

c) distilling said mixture and recovering a deethanized stream comprising $C_{3+}$ alkanes;

d) contacting step (a) intermediate $C_4$ hydrocarbon stream with shape selective medium pore zeolite catalyst particles in a conversion zone under conditions comprising temperature between about 475° and 800° F., pressure between about 400 and 2000 psig, and weight hourly space velocity between about 0.1 and 50 to convert n-butane to propane and $C_5+$ gasoline boiling range hydrocarbons with no substantial formation of hydrocarbons having less than three carbon atoms;

e) introducing step (c) deethanized stream and step (d) propane and $C_5+$ hydrocarbons to step (a) fractionator wherein propane is separated and recovered in said overhead stream, $C_4$ hydrocarbons are separated and recovered in said intermediate stream and a bottom stream comprising said $C_5+$ gasoline is recovered.

2. The process of claim 1 further comprising stripping step (a) intermediate stream to recycle a stripper propane overhead stream to said fractionator and provide a stripper bottom stream comprising $C_4$ paraffinic hydrocarbons; and passing said stripper bottom stream to step (d) conversion zone.

3. The process of claim 2 wherein said stripper bottom stream is separated in a deisobutanizer fractionator to recover a deisobutanizer overhead comprising isobutane and a bottom stream comprising normal butane; and passing said n-butane to said step (d) conversion zone.

4. The process of claim 1 wherein step (b) zeolite catalyst is selected from the group consisting of ZSM-5, ZSM-11, ZSM-12, ZSM-22, ZSM-23, ZSM-34, ZSM-35, ZSM48, ZSM-50, MCM-22 and zeolite Beta.

5. The process of claim 1 wherein step (d) zeolite catalyst is selected from the group consisting of ZSM-5, ZSM-11, ZSM-12, ZSM-22, ZSM-23, ZSM-34, ZSM-35, ZSM-48, ZSM-50, MCM-22 and zeolite Beta.

6. The process of claim 1 wherein said step (b) catalyst comprises ZSM-5.

7. The process of claim 1 wherein said step (d) catalyst comprises ZSM-5.

8. A process for the conversion of $C_3$–$C_4$ paraffin-rich hydrocarbons to $C_5+$ gasoline boiling range hydrocarbons, comprising:

a) separating a paraffin-rich feedstream comprising $C_3$–$C_4$ hydrocarbons in a fractionator to recover an overhead stream comprising propane and an intermediate stream containing $C_4$ hydrocarbons rich in n-butane and propane;

b) stripping said intermediate stream to provide a stream comprising n-butane rich $C_4$ hydrocarbons and a stream comprising propane;

c) contacting step (b) $C_4$ hydrocarbon stream with shape selective medium pore zeolite catalyst particles under conditions comprising temperature between about 475° and 800° F., pressure between about 400 and 2000 psig, and weight hourly space velocity between about 0.1 and 50 to convert said n-butane to an effluent stream containing propane and $C_5+$ gasoline boiling range hydrocarbons with no substantial formation of hydrocarbons having less than three carbon atoms;

d) recycling step (b) propane stream to said fractionator and passing said overhead stream to a conversion zone in contact with shape selective, medium pore zeolite catalyst particles under conversion conditions comprising temperature between about 500° and 900° F., pressure between about 50 and 1500 psig, and weight hourly space velocity between about 0.1 and 10 to convert propane to a mixture comprising $C_2+$ alkanes;

e) deethanizing step (d) mixture and passing the deethanized product comprising $C_3+$ alkanes to said fractionator for separation;

f) separating step (c) effluent stream in said fractionator and recovering said $C_5+$ gasoline boiling range hydrocarbons.

9. The process of claim 8 wherein step (c) zeolite catalyst is selected from the group consisting of ZSM-5, ZSM-11, ZSM-12, ZSM-22, ZSM-23, ZSM-34, ZSM-35, ZSM-48, ZSM-50, MCM-22 and zeolite Beta.

10. The process of claim 8 wherein step (d) zeolite catalyst is selected from the group consisting of ZSM-5, ZSM-11, ZSM-12, ZSM-22, ZSM-23, ZSM-34, ZSM-35, ZSM-48, ZSM-50, MCM-22 and zeolite Beta.

11. The process of claim 8 wherein said step (c) catalyst comprises ZSM-5.

12. The process of claim 8 wherein said step (d) catalyst comprises ZSM-5.

13. A continuous integrated process for the conversion of n-butane to $C_5+$ gasoline, comprising:

a) contacting a feedstream comprising fresh normal butane with shape selective medium pore zeolite catalyst particles in a conversion zone under conditions comprising temperature between about 475° and 800° F., pressure between about 400 and 2000 psig, and weight hourly space velocity between about 0.1 and 50 to convert said n-butane to an effluent stream comprising $C_3+$ alkanes with no substantial formation of hydrocarbons having less than three carbon atoms;

b) separating said effluent steam in a fractionator to recover an overhead steam comprising propane;

c) contacting said propane stream with shape selective, medium pore zeolite catalyst particles in a conversion zone under conditions comprising temperature between about 500° and 900° F., pressure between about 50 and 1500 psig, and weight hourly space velocity between about 0.1 and 10 to convert said propane to a mixture comprising $C_2+$ alkanes;

d) deethanizing said mixture and passing the deethanized product comprising $C_{3+}$ alkanes and said effluent stream to said fractionator for concurrent separation;

e) recovering a bottom stream from said fractionator comprising $C_5+$ gasoline;

f) distilling an intermediate stream from said fractionator comprising $C_4$ alkanes and recovering a stream comprising isobutane and a stream comprising unconverted normal butane;

g) recycling said unconverted normal butane to step (a) conversion zone.

14. The process of claim 13 wherein step (a) and step (c) zeolite catalyst is selected from the group consisting of ZSM-5, ZSM-11, ZSM-12, ZSM-22, ZSM-23, ZSM-34, ZSM-35, ZSM-48, ZSM-50, MCM-22 and zeolite Beta.

15. The process of claim 13 wherein said step (a) and step (c) catalyst comprises ZSM-5.

16. An integrated continuous process for the production of $C_5+$ gasoline from propane and normal butane, comprising:

a) separating fresh $C_3$–$C_4$ paraffinic hydrocarbon feedstream in a fractionator and recovering a stream comprising propane and another stream rich in normal butane;

b) contacting the propane stream with shape selective, medium pore zeolite catalyst particles in a propane conversion zone under propane conversion conditions comprising temperature between about 500° and 900° F., pressure between about 50 and 1500 psig, and weight hourly space velocity between about 0.1 and 10 whereby an effluent stream is produced rich in $C_4+$ paraffinic hydrocarbons;

c) contacting the stream rich in normal butane with shape selective, medium pore zeolite catalyst particles in a normal butane conversion zone under normal butane conversion conditions comprising temperature between about 475° and 800° F., pressure between about 400 and 2000 psig, and weight hourly space velocity between about 0.1 and 50 whereby an effluent stream is produced rich in $C_3$+ paraffinic hydrocarbons; and d) separating step (b) effluent stream and step (c) effluent stream in step (a) fractionator in conjunction with said $C_3$-$C_4$ feedstream whereby a bottom stream is recovered from said fractionator comprising $C_5$+ gasoline.

17. The process of claim 16 wherein step (b) zeolite catalyst is selected from the group consisting of ZSM-5, ZSM-11, ZSM-12, ZSM-22, ZSM-23, ZSM-34, ZSM-35, ZSM-48, ZSM-50, MCM-22 and zeolite Beta.

18. The process of claim 16 wherein step (c) zeolite catalyst is selected from the group consisting of ZSM-5, ZSM-11, ZSM-12, ZSM-22, ZSM-23, ZSM-34, ZSM-35, ZSM-48, ZSM-50, MCM-22 and zeolite Beta.

19. The process according to claim 1 wherein step (b) conditions comprise temperature between about 600°-800° F., pressure between about 400-1000 psig and weight hourly space velocity between about 0.2 and 2.0; and step (d) conditions comprise temperature between about 500°-750° F., pressure between about 600-1500 psig and weight hourly space velocity between about 0.1 and 10.

20. The process according to claim 8 wherein step (d) conditions comprise temperature between about 600°-800° F., pressure between about 400-1000 psig and weight hourly space velocity between about 0.2 and 2.0; and step (c) conditions comprise temperature between about 500°- 750° F., pressure between about 600-1500 psig and weight hourly space velocity between about 0.1 and 10.

21. The process according to claim 13 wherein step (c) conditions comprise temperature between about 600°-800° F., pressure between about 400-1000 psig and weight hourly space velocity between about 0.2 and 2.0; and step (a) conditions comprise temperature between about 500°-750° F., pressure between about 600-1500 psig and weight hourly space velocity between about 0.1 and 10.

22. The process according to claim 16 wherein step (b) conditions comprise temperature between about 600°-800° F., pressure between about 400-1000 psig and weight hourly space velocity between about 0.2 and 2.0; and step (c) conditions comprise temperature between about 500°-750° F., pressure between about 600-1500 psig and weight hourly space velocity between about 0.1 and 10.

* * * * *